US010399343B2

(12) United States Patent
Suzuki et al.

(10) Patent No.: US 10,399,343 B2
(45) Date of Patent: Sep. 3, 2019

(54) INKJET RECORDING APPARATUS AND INK INFORMATION DISPLAY METHOD FOR INKJET RECORDING APPARATUS

(71) Applicant: Hitachi Industrial Equipment Systems Co., Ltd., Chiyoda-ku, Tokyo (JP)

(72) Inventors: Ryosuke Suzuki, Tokyo (JP); Manabu Kato, Tokyo (JP); Masahiko Sakuraba, Tokyo (JP); Keisuke Nagai, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 15/758,449

(22) PCT Filed: Aug. 5, 2016

(86) PCT No.: PCT/JP2016/073079
§ 371 (c)(1),
(2) Date: Mar. 8, 2018

(87) PCT Pub. No.: WO2017/043229
PCT Pub. Date: Mar. 16, 2017

(65) Prior Publication Data

US 2018/0250941 A1 Sep. 6, 2018

(30) Foreign Application Priority Data

Sep. 9, 2015 (JP) ..... 2015-177778

(51) Int. Cl.
*B41J 29/393* (2006.01)
*B41J 2/175* (2006.01)
(Continued)

(52) U.S. Cl.
CPC ..... *B41J 2/17503* (2013.01); *B41J 2/01* (2013.01); *B41J 2/08* (2013.01); *B41J 2/085* (2013.01);
(Continued)

(58) Field of Classification Search
USPC ..... 347/19
See application file for complete search history.

(56) References Cited

U.S. PATENT DOCUMENTS 6,158,837 A * 12/2000 Hilton ..... B41J 2/17546 347/19
6,547,363 B1 * 4/2003 Shinada ..... B41J 2/17503 347/19
(Continued)

FOREIGN PATENT DOCUMENTS

CN 103171307 A 6/2013
JP 2003-98907 A 4/2003
(Continued)

OTHER PUBLICATIONS

International Search Report (PCT/ISA/210) issued in PCT Application No. PCT/JP2016/073079 dated Nov. 1, 2016 with English-language translation (five (5) pages).
(Continued)

*Primary Examiner* — Lam S Nguyen
(74) *Attorney, Agent, or Firm* — Crowell & Moring LLP

(57) ABSTRACT

In order to make it possible to inform as apparatus handler through a simple, means of precautions to take in handling ink of the correct ID number when an inputted ink ID number is correct, this inkjet recording apparatus is provided with a print head having; a nozzle part, an ink container that houses ink supplied to the nozzle part, information reading unit for reading information that distinguishes the type of ink accompanying an ink supply container that supplies ink
(Continued)

to the ink container, a determination unit for determining from the read information whether the ink housed in the ink supply container is the correct ink, a storage unit for storing ink-related information in correlation with the ink-type-distinguishing information, a stored-information extraction unit for extracting from the storage unit the ink-related information corresponding to the ink-type-distinguishing information read by the information reading unit when the ink is determined to be correct by the determination unit, and a display unit for displaying the ink-related information extracted toy the stored-information extraction unit on a screen.

14 Claims, 3 Drawing Sheets

(51) Int. Cl.

| | |
|---|---|
| ***B41J 2/01*** | (2006.01) |
| ***B41J 2/195*** | (2006.01) |
| ***B41J 29/38*** | (2006.01) |
| ***B41J 29/42*** | (2006.01) |
| ***B41J 2/135*** | (2006.01) |
| ***B41J 2/08*** | (2006.01) |
| ***B41J 2/085*** | (2006.01) |
| ***B41J 2/09*** | (2006.01) |
| ***B41J 2/095*** | (2006.01) |
| ***B41J 2/105*** | (2006.01) |
| *B41J 2/185* | (2006.01) |

(52) U.S. Cl.

CPC ..... *B41J 2/09* (2013.01); *B41J 2/095* (2013.01); *B41J 2/105* (2013.01); *B41J 2/135* (2013.01); *B41J 2/175* (2013.01); *B41J 2/17546* (2013.01); *B41J 2/17596* (2013.01); *B41J 2/195* (2013.01); *B41J 29/38* (2013.01); *B41J 29/42* (2013.01); *B41J 2002/1853* (2013.01)

(56) References Cited

U.S. PATENT DOCUMENTS

| | | | | |
|---|---|---|---|---|
| 6,938,976 | B2 * | 9/2005 | Siwinski | B41J 2/175 347/19 |
| 6,984,020 | B2 | 1/2006 | Shinada et al. | |
| 8,485,622 | B2 * | 7/2013 | Ogasawara | B41J 2/175 347/19 |
| 2005/0110823 | A1 | 5/2005 | Kobayashi et al. | |
| 2005/0134659 | A1 | 6/2005 | Suda et al. | |
| 2009/0015622 | A1 | 1/2009 | Karaki et al. | |
| 2009/0167796 | A1 | 7/2009 | Ueda | |
| 2012/0092716 | A1 | 4/2012 | Ichimura et al. | |
| 2012/0249625 | A1 | 10/2012 | Asada | |
| 2015/0298461 | A1 | 10/2015 | Koganehira et al. | |

FOREIGN PATENT DOCUMENTS

| | | | |
|---|---|---|---|
| JP | 2004-130574 | A | 4/2004 |
| JP | 2005-313332 | A | 11/2005 |
| JP | 2007-190728 | A | 8/2007 |
| JP | 2009-6625 | A | 1/2009 |
| JP | 2010-89288 | A | 4/2010 |
| JP | 2010-173180 | A | 8/2010 |
| JP | 2012-84048 | A | 4/2012 |
| JP | 4945295 | B2 | 6/2012 |
| JP | 2014-46612 | A | 3/2014 |
| JP | 2015-109029 | A | 6/2015 |

OTHER PUBLICATIONS

Japonese-language Written Opinion (PCT/ISA/237) issued in PCT/JP2016/073079 dated Nov. 1, 2016 (three (3) pages).

Extended European Search Report issued in counterpart European Application No. 16844093.1 dated Apr. 8, 2019 (nine (9) pages).

Japanese-language Office Action issued in counterpart Japanese Application No. 2015-177778 dated May 21, 2019 with English translation (10 pages).

* cited by examiner

INKJET RECORDING APPARATUS AND INK INFORMATION DISPLAY METHOD FOR INKJET RECORDING APPARATUS

TECHNICAL FIELD

The present invention relates to an inkjet recording apparatus and an ink information display method for an Inkjet recording apparatus.

BACKGROUND ART

As an invention related to an inkjet recording apparatus (printer), the following invention is disclosed in latent Document 1: in ABSTRACT, "to reduce a cost associated with production of printer drivers by supporting a plurality of destinations with one printer driver" is stated as PROBLEM, and "A printer driver 204 that controls an operation of an Inkjet printer 100 in which ink can be supplemented from the outside causes a computer to execute an acquisition function of acquiring attribute information related to a destination of the Inkjet printer 100, an input function to which an ink ID number allocated to ink to be supplemented is input, an ink determination function of analyzing the ink ID number and determining whether or not ink is appropriate, and a selection execution function of selecting, when ink is determined not to be appropriate, one of a plurality of processes for inappropriate ink on the basis of the attribute information related to the destination and executing the selected process." is stated as SOLUTION.

CITATION LIST

Patent Document

Patent Document 1; JP 2012-84048 A

SUMMARY OF THE INVENTION

Problems to be Solved by the Invention

In Patent Document 1, the Inkjet printer analyzes an input ink ID number, determines whether ink is appropriate, and selects and executes one of a plurality of processes for inappropriate ink when ink is determined not to be appropriate. However, a process executed when ink is determined to be appropriate is not mentioned.

The inkjet printers are widely used all over the world, and languages used by handlers who handle the inkjet printers are diverse. Therefore, a language displayed on a screen of the Inkjet printer is required to be a language corresponding to an apparatus handler.

Since ink or solvent used in the inkjet recording apparatus may be dangerous if not handled properly, it is necessary to inform the handler of appropriate precautions currently, it is indicated on a label on an ink or solvent bottle, but there is a limitation to the display in the label since required display content differs for each country or region, and display languages are diverse.

in Patent Document 1, measures to be taken when an input ink ID number is incorrect are described. However, information to be displayed for an apparatus handler when an input ink ID number is correct is not described, and a technique of presenting next information in a language used by an apparatus handler is not considered.

The present invention was made to solve the problems of the related art described above, and it is preferable to provide an inkjet recording apparatus and an ink information display method for an inkjet recording apparatus, which are capable of informing an apparatus handler of precautions for ink handling of a correct ID through a simpler means when an input ink ID number is correct.

Solutions to Problems

In order to solve the above-mentioned problems, the present invention provides an inkjet recording apparatus including a print head that includes a nozzle unit ejecting ink, an ink container that contains ink to be supplied to the nozzle unit of the print head, an information reading unit that reads information which is attached to an ink supply container that supplies the ink to the ink container and identifies a type of ink contained in the ink supply container, a determination unit that determines whether or not the type of ink contained in the ink supply container is correct ink to be supplied to the ink container from the information read by the information reading unit, a storage unit that stores information related to the ink in association with the information identifying the type of ink, a storage information extracting unit that extracts the information related to the ink corresponding to the information identifying the type of the ink contained in the ink supply container read by the information reading unit from the storage unit when the determination unit determines that the type of the ink contained in the ink supply container is the correct ink to be supplied to the ink container, and a display unit that displays the information related to the ink extracted by the storage information extracting unit on a screen.

Further, in order to solve the above-mentioned problem, the present invention provides an ink information display method for an Inkjet recording apparatus that ejects ink contained in an ink container in a particle form from a nozzle unit of a print head and performs printing on a print target, including reading, by an information reading unit, information which is attached to an ink supply container that supplies the ink to the ink container and identifies a type of ink contained in the ink supply container, determining, by a determination unit, whether or not the type of ink contained in the ink supply container is correct ink to be supplied to the ink container from the information read by the information reading unit, extracting by a storage information extracting unit, information related to the ink stored in a storage unit in advance in association with the information identifying the type of the ink when the determination unit determines that the type of the ink contained in the ink supply container is the correct ink to be supplied to the ink container, and displaying the information related to the ink extracted by the storage information extracting unit on a screen of a display unit.

Effects of the Invention

According to the present invention, when an input ink ID number is correct, it is possible to provide the apparatus handler with information related to ink of the correct ID, and it is possible to provide the apparatus handler with information related to correct handling of exchanged ink and precautions and information related to an exchange period of ink.

Mode for Carrying out the Invention

The present invention relates to an inkjet recording apparatus having a function of reading information of a type of ink or solvent contained an ink or solvent bottle and displaying a composition of ink or solvent or precaution data previously stored in a storage unit and an ink information display method for the Inkjet recording apparatus.

Hereinafter, an embodiment of the present invention will be described with reference to the appended drawings.

Embodiment

Figure 1:
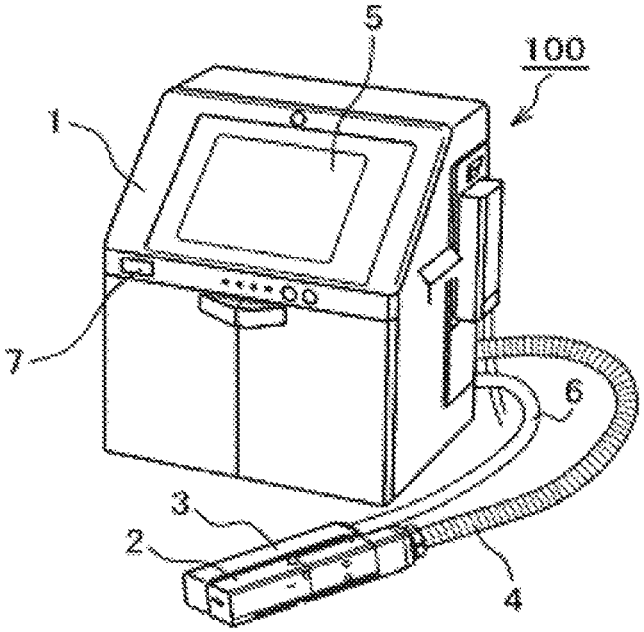
FIG. 1 is a perspective view illustrating an overall configuration of an inkjet recording apparatus according to an embodiment of the present invention.

An overall configuration of an inkjet recording apparatus according to the present invention is illustrated in FIG. 1. The inkjet recording apparatus according to the present embodiment includes a main body 1, a print head 2, a printed matter detector 3, a cable 3 that connects the print head with the main body 1, a display screen 5 that displays information on the main body 1, a cable 6 that connects the printed matter detector 3 with the main body 1, and a reading unit 7 that reads information of a wireless IC chip affixed to a container in which ink is contained.

Figure 2:
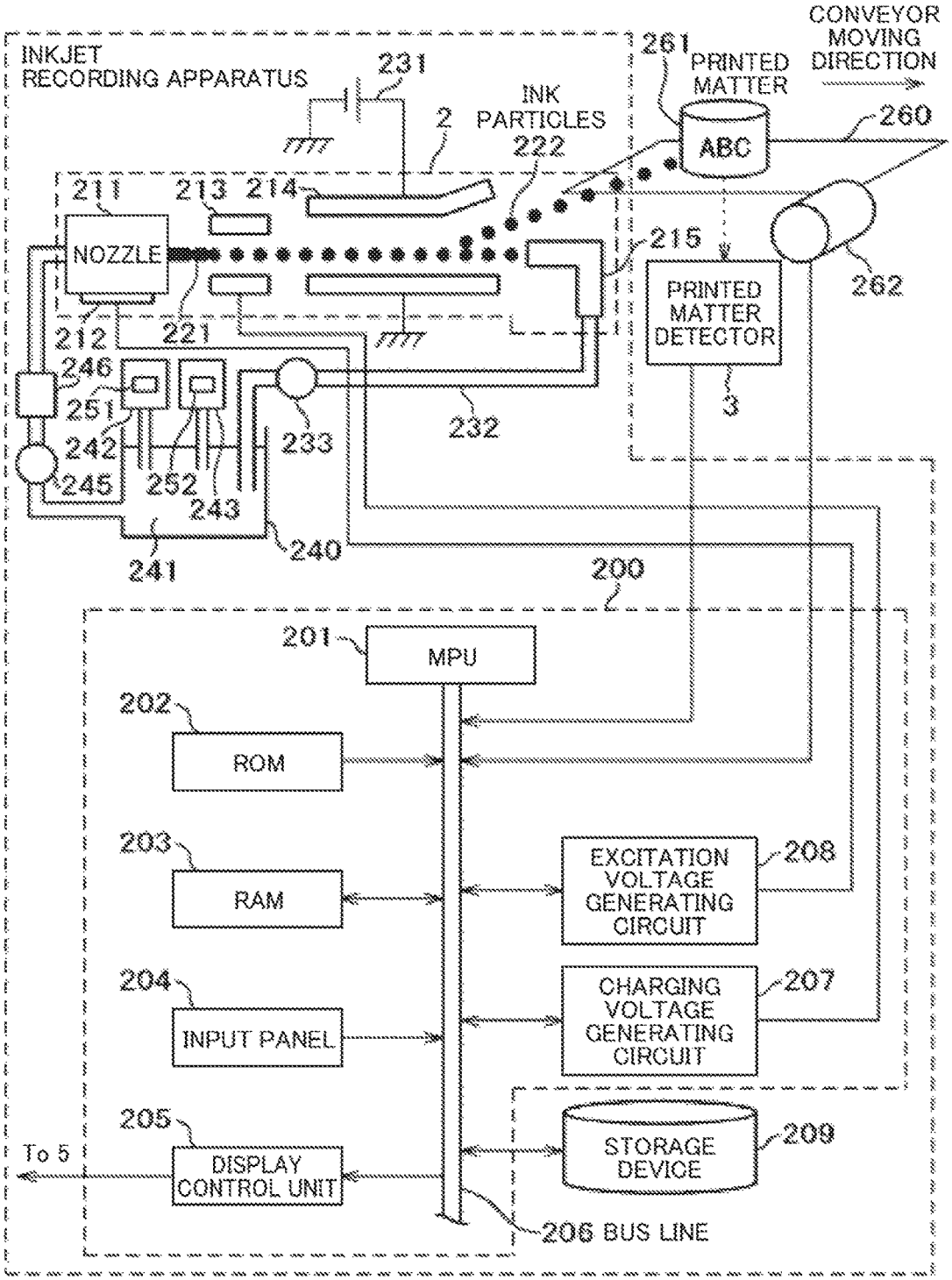
FIG. 2 is a block diagram illustrating a schematic configuration of a print head, a control unit, and an ink tank of an inkjet recording apparatus according to an embodiment of the present invention.

FIG. 2 illustrates a configuration of the print head 2 illustrated in FIG. 1 and a configuration of a control unit 200 in the main body 1.

The print head 2 includes a nozzle 211, a vibrator 212 that causes the nozzle 211 to perform ultrasonic vibration, a charging electrode 213 that forms electrolysis for performing charging according to a shape of a character to be printed on ink particles passing between a pair of electrode plates, a deflecting electrode 214 that forms electrolysis between a pair of electrode plates and changes the trajectory in accordance with a charged amount of the ink particles charged by the charging electrode 213, and a gutter 215 that collects ink particles which pass through between the deflecting electrode 214 and are not contributed to printing. The print head 2 performs printing on a printed matter 261 serving as a print target conveyed by a conveyer 260 whose movement is monitored by a rotary encoder 262 in a production line or the like. A character printed on the printed matter 261 is imaged by a printed matter detector 3 equipped with a camera, and it is checked whether or not the character is correctly printed. The deflecting electrode 214 is connected to a high voltage source 231 installed on the main body 1 side, and a high voltage is applied to the deflecting electrode 214.

The control unit 200 includes a micro processing unit (MPU) 201 that controls the entire inkjet recording apparatus, a ROM or flash memory 202 that stores a control program and data necessary for the operation of the MPU 201, and a RAM 203 that temporarily stores data necessary while the program is being executed.

The control unit 200 is correctable with an external storage device (storage device) 209 that stores a program, print data, and the like such as a USB memory. The control unit 200 farther includes an input panel 204 for inputting print content, a setting value, and the like, a display control unit 205 that performs controls such that input data, print content, or the like is displayed on the display screen 5, and a bus line 206 for transmitting a data signal, an address signal, and a control signal of the MPU 201.

The control unit 200 further includes an excitation voltage generating circuit 208 that applies a voltage for generating high frequency vibration for transforming an ink pillar 221 immediately after being ejected from the nozzle 211 into ink particles to a piezoelectric element 212 connected to the nozzle 211, a charging voltage generating circuit 207 that forms an electric field for charging ink particles 222 passing through a pair of electrode plates of the charging electrode 213 by an amount corresponding to a character signal for printing, and the deflecting electrode 214 that forms an electric field for deflecting the trajectory of the ink particles charged while passing through the charging voltage generating circuit 207. Further, a rotary encoder 219 generates a pulse signal in accordance with a moving speed of the conveyer 260. Since the rotary encoder 219 is installed in not an Inkjet recording apparatus 100 but the conveyer 260, various types of rotary encoders can be used, for example, an existing rotary encoder may be used, or a rotary encoder may be used prepared by the user may be used.

Next, a configuration overview of a printing and ink circulating part will be described. Ink 241 contained in an ink tank 240 installed on the main body 1 side is sucked up by a pump 245 and supplied to the nozzle 211 in a state in which pressure is adjusted by a pressure reducing valve 246. The ink supplied to the nozzle 211 is ejected from the nozzle 211 and becomes the ink pillar 221, and the ink pillar 221 is transformed into ink particles 222 by the high frequency vibration of the piezoelectric element 212 which is connected to the nozzle 211 and driven with the excitation voltage generated by the excitation voltage generating circuit 208.

The ink particles are charged by the electric field formed by the charging electrode 213 when passing between a pair of electrodes of the charging electrode 213. A voltage according to the character signal corresponding to a character to be printed on the printed matter 261 is applied to the charging electrode 213 through the charging voltage generating circuit 207. Accordingly, electric charges according to the character signal are accumulated, and the ink particles 222 are charged. The charged ink particles 222 fly through the electric field formed by the deflecting electrode 214, are deflected in accordance with a charge amount thereof, arrive at the printed matter 261 being moved by the conveyer 260 for conveyance, and form a character. The ink particles which are not used for printing are collected by the gutter 215 for ink collection, pass through a pipe 232, and are collected into the ink tank 240 by the pump 233.

Meanwhile, an ink cartridge 242 and a solvent cartridge 243 for ink supply are connected to the ink tank 240, and as an amount of the ink 241 in the ink tank 240 decreases, the ink is supplied from the ink cartridge 242, and a solvent is supplied from the solvent cartridge 243.

Wireless IC chips (IC tags) 251 and 252 are attached to the surface of the ink cartridge 242 and the surface of the solvent cartridge 243, respectively. An ID number related to a type of ink or solvent contained therein or information related to an expiration date is stored in the wireless IC chips (IC tags) 251 and 252.

Figure 3:
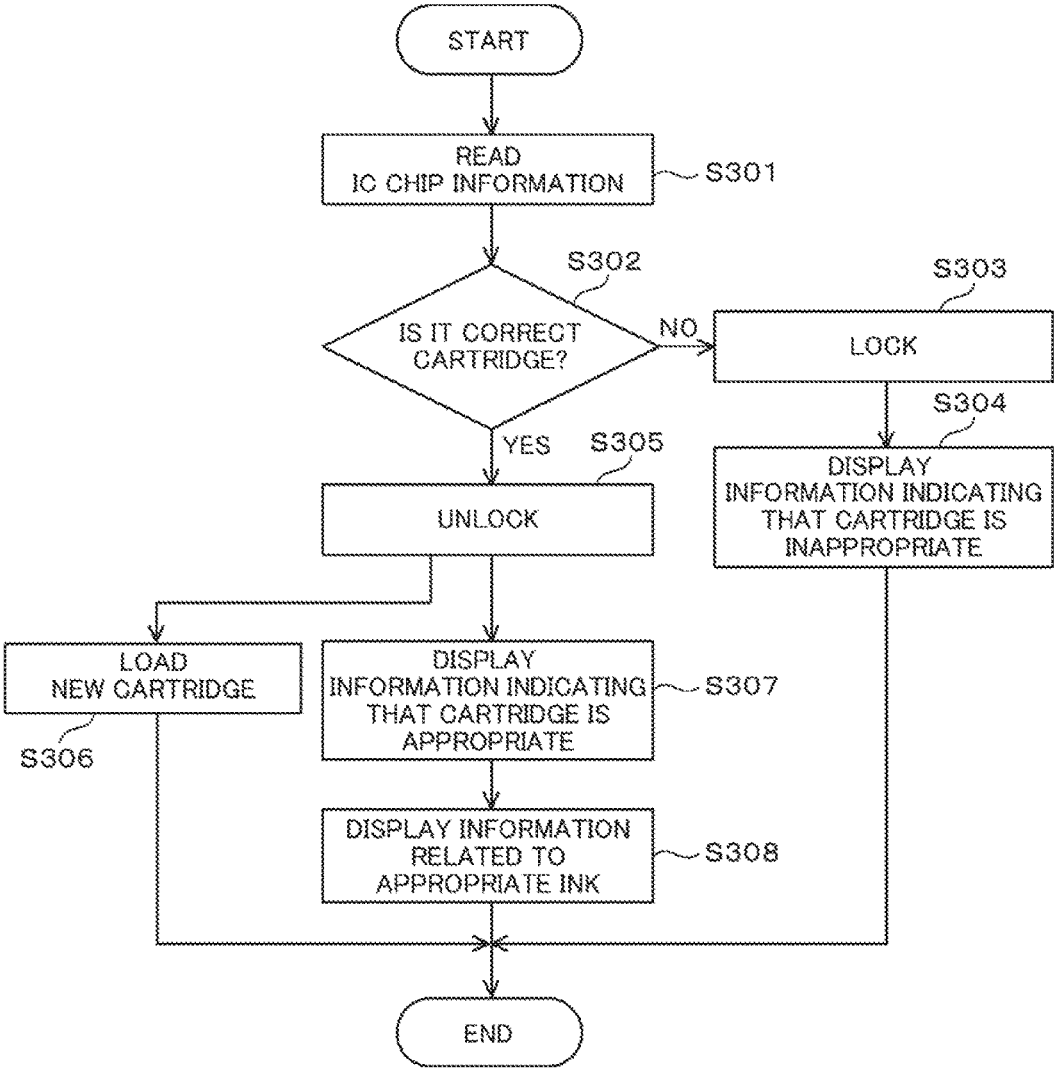
FIG. 3 is a flowchart illustrating the flow of a process of a method for displaying ink information of an inkjet recording apparatus according to an embodiment of the present invention.

Regarding the information stored in the wireless IC chips (IC tags) 251 and 252, when the ink cartridge 242 and the solvent cartridge 243 are loaded into the main body 1, the information written in the wireless IC chips (IC tags) 251 and 252 is first read by the reading unit 7 of the main body 1 and processed in accordance with the flow illustrated in FIG. 3.

First, the information written in the wireless IC chips (IC tags) 251 and 252 is read by the reading unit 7 of the main body 1 (S301), and the read information is transferred to the MPU 201. The MPU 201 compares the ink information corresponding to the ink ID number and the solvent ID number read from the wireless IC chips (IC tags) 251 and 252 with the information stored in the storage device 209, and determines whether or not the ink cartridge 242 and the solvent cartridge 243 are an ink cartridge and a solvent cartridge which are supposed to be originally loaded (S302).

When a negative determination is obtained as a result of determination, that is, when the ink cartridge 242 and the solvent cartridge 243 are determined not to be an ink cartridge and a solvent cartridge which are supposed to be originally loaded and inappropriate (NO in S302), an alarm is issued, and an ink cartridge mounting portion (not illustrated) is locked (S303), and thus a wrong ink cartridge or solvent cartridge is unable to be loaded into the main body 1. Further, information indicating that the cartridge or the solvent cartridge is inappropriate is displayed on the display screen 5 (S304).

On the other hand, when the ink cartridge 242 and the solvent cartridge 243 are determined to be a correct ink cartridge and a correct solvent cartridge as a result of determination (YES in S302), of the ink cartridge mounting portion and the solvent cartridge mounting portion (not illustrated) of the main body 1 are unlocked (S305), and the ink cartridge and the solvent cartridge can be loaded into the main body 1 (3306). Further, information indicating that the ink cartridge and the solvent cartridge are appropriate is displayed on the display screen 5 (S307).

Then, the MPU 201 reads information related to a type of ink and precautions for handling and information related to a type of solvent and precautions for handling which are stored in the storage device 209 corresponding to the ID number of the appropriate ink read from the wireless IC chips (IC tags) 251 and 252 by the reading unit 7 and causes the read information to be displayed on the display screen 5 via the display control unit 205 together with the information related to the expiration date of the ink and the solvent to be exchanged read from the wireless IC chips (IC tags) 251 and 252. As a result, information related to a composition of the ink and precautions for ink handling and information related to a composition of the solvent and precautions for solvent handling are displayed on the display screen 5 as the information related to a type of ink and the information related to a type of solvent, and the exchange periods of the ink cartridge and the solvent are displayed on the display screen 5 as the information related to the expiration date (S308).

Here, the information to be displayed on the display screen 5 in S308 is displayed in a language selected from a plurality of prepared languages and registered in advance. In other words, a language selected according to an operator who operates or maintains the Inkjet recording apparatus 100 is registered in advance, and thus it can be displayed in a language understandable by the handler who operates or maintains the Inkjet recording apparatus 100.

In the above embodiment, the example in which the ink cartridge 242 and the solvent cartridge 243 are exchanged at the same time has been described above, but one of the ink cartridge 242 and the solvent cartridge 243 may be exchanged. In this case, information related to one to be exchanged, that is, one of the ink and the solvent is displayed on the display screen 5.

In the above embodiment, the example using the ink cartridge 242 and the solvent cartridge 243 has been described above, but the present embodiment is not limited thereto and can be applied even when the ink or the solvent is inserted into a supply bottle and supplied. In this case, it is preferable to attach a wireless IC chip (IC tag) to the supply bottle and store the information related to the ink ID number or the expiration date.

Further, a language to be displayed on the display screen 5 has been described as a language which is registered in advance, but it is also possible to cause a plurality of languages to be displayed on the display screen 5 and cause a desired language to be selected on the display screen. Further, as a language to be displayed on the display screen 5, a plurality of languages may be displayed simultaneously or in a switching manner or may be scrolled and sequentially displayed.

In the above-described embodiment, the example in which the wireless IC chip (IC tag) is attached to the ink cartridge has been described above, but a bar code may be attached instead of the wireless IC chip (IC tag). In this case, it is preferable to use a barcode reader instead of the reading unit 7 on the main body 1 side.

Since the ink or the solvent used in the inkjet recording apparatus 100 may be dangerous if not handled correctly, it is necessary to inform the; user of appropriate precautions. In a case in which such information is indicated on a label on an ink or solvent cartridge (bottle), there is a limitation to the display in the label since required display content differs for each country or region, and display languages are diverse.

On the other hand, in the present embodiment, such information is stored in the storage device 209 in association with the ink ID number and the solvent ID number, the ink ID number and the solvent ID number are stored in the wireless IC chip (IC tag) 251 or 252 corresponding to the labels on the ink cartridge and the solvent cartridge, and thus it is possible to read the information related to the ink corresponding to the ink ID number and the information related to the solvent corresponding to the solvent ID number from the storage device 209 and cause the read information to be displayed on the screen, and it is possible to easily deal with the display content and the display language which differ for each country or region which are unable to be dealt with using an indication on the label. As described above, since it is possible to display the information related to the type of ink or solvent and the information related to the expiration date in a selected language, it is possible to provide an apparatus handler with the information related to the ink and the solvent of the correct ID, if is possible to provide the handler or an administrator with information related to correct handling of the exchanged ink and solvent, information related to precautions, and the information related to the exchange period of the ink or the solvent, and it is possible to prevent an accident at the time of handling.

REFERENCE SIGNS LIST

1 main body
2 print head
3 printed matter detector
5 display screen
7 reading unit

100 inkjet recording apparatus
201 MPU
202 ROM
203 RAM
204 input panel
205 display control unit
207 charging voltage generating circuit.
208 excitation voltage generating circuit
209 storage device
211 nozzle
213 charging electrode
214 deflecting electrode
215 gutter
240 ink tank
242 ink cartridge
243 solvent cartridge
251, 252 wireless IC chip (IC tag)

The invention claimed is:

1. An Inkjet recording apparatus, comprising:

a print head that include, a nozzle unit ejecting ink;

an ink container that contains ink to be supplied to the nozzle unit of the print head;

an information reading unit that reads information which is attached to an ink supply container that supplies the ink to the ink container and identifies a type of ink contained in the ink supply container;

a determination unit that determines whether or not the type of ink contained in the ink supply container is correct ink to be supplied to the ink container from the information read by the information reading unit;

a storage unit that stores information related to the ink in association with the information identifying the type of ink;

a storage information extracting unit that extracts the information related to the ink corresponding to the information identifying the type of the ink contained in the ink supply container read by the information reading unit from the storage unit when the determination unit determines that the type of the ink contained in the ink supply container is the correct ink to be supplied to the ink container; and a display unit that displays the information related to the ink extracted by the; storage information extracting unit on a screen.

2. The Inkjet recording apparatus according to claim 1, wherein the storage unit stores information related to a composition of the ink and information related to precautions for handling of the ink as the information related to the ink in association with the information identifying the type of the ink.

3. The Inkjet recording apparatus according to claim 1, wherein the storage unit stores the information related to the ink in a plurality of languages.

4. The Inkjet recording apparatus according to claim 1, wherein the display unit displays the information related to the ink stored in a preselected language or a language selected on the screen of the display unit among the information related to the ink stored in the storage unit in a plurality of languages.

5. The Inkjet recording apparatus according to claim 1, wherein the information reading unit further reads information which is attached to a solvent supply container that supplies a solvent to the ink container and identifies a type of solvent contained in the solvent supply container.

6. The inkjet recording apparatus according to claim 5, wherein the storage unit stores information related to a composition of the solvent and information related to precautions for handling of the solvent as information related to the solvent in association with the information identifying the type of the solvent.

7. The Inkjet recording apparatus according to claim 5, wherein the storage unit stores the information related to the ink and the solvent in a plurality of languages, and the display unit displays the information related to the ink and/or the solvent stored in a preselected language or a language selected on the screen of the display unit among the information related to the ink and/or the solvent stored in the storage unit in a plurality of languages.

8. An ink information display method for an Inkjet recording apparatus that ejects ink contained in an ink container in a particle form from a nozzle unit of a print head and performs printing on a print target, comprising:

reading, by an information reading unit, information which is attached to an ink supply container that supplies the ink to the ink container and identifies a type of ink contained in the ink supply container;

determining, by a determination unit, whether or not the type of ink contained in the ink supply container is correct ink to be supplied to the ink container from the information read by the information reading unit;

extracting, by a storage information extracting unit, information related to the ink stored in a storage unit in advance in association with the information identifying the type of the ink when the determination unit, determines that the type of the ink contained in the ink supply container is the correct ink to be supplied to the ink container; and displaying the information related no the ink extracted by the storage information extracting unit on a screen of a display unit.

9. The ink information display method for the inkjet recording apparatus according to claim 8, wherein the information related to the ink stored in the storage Unit is information in which information related to a composition of the ink and information related to precautions for handling of the ink are associated with the information identifying the type of the ink.

10. The ink information display method for the inkjet recording apparatus according to claim 8, wherein the information related to the ink stored in the storage unit is stored in a plurality of languages.

11. The ink information display method for the inkjet recording apparatus according to claim 8, wherein the information related to the ink stored in a preselected language or a language selected on the screen of the display unit among the information related to the ink stored in the storage unit in a plurality of languages is displayed on the display unit.

12. The ink information display method for the inkjet recording apparatus according to claim 8, wherein the information reading unit further reads information which is attached to a solvent supply container that supplies a solvent to the ink container and identifies a type of solvent contained in the solvent supply container.

13. The ink information display method for the inkjet recording apparatus according to claim 12, wherein information related to a composition of the solvent and information related to precautions for handling of the solvent are stored in the storage unit as information related to the solvent in association with the information identifying the type of the solvent.

14. The ink information display method for the Inkjet recording apparatus according to claim 12, wherein the information related to the ink and the solvent is stored in the storage unit in a plurality of languages, and the information related to the ink and/or the solvent stored in a preselected language or a language selected on the screen of the display unit among the information related to the ink and/or the solvent stored in the storage unit in a plurality of languages is displayed on the display unit.

* * * * *